US012753772B2

(12) United States Patent
Nakaniwa et al.

(10) Patent No.: US 12,753,772 B2
(45) Date of Patent: Oct. 6, 2026

(54) IMPELLER AND CENTRIFUGAL COMPRESSOR

(71) Applicant: MITSUBISHI HEAVY INDUSTRIES COMPRESSOR CORPORATION, Hiroshima (JP)

(72) Inventors: Akihiro Nakaniwa, Tokyo (JP); Hideki Nagao, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 0 days.

(21) Appl. No.: 19/142,702

(22) PCT Filed: Dec. 11, 2023

(86) PCT No.: PCT/JP2023/044252
§ 371 (c)(1),
(2) Date: Jun. 24, 2025

(87) PCT Pub. No.: WO2024/142886
PCT Pub. Date: Jul. 4, 2024

(65) Prior Publication Data

US 2026/0218720 A1 Jul. 30, 2026

(30) Foreign Application Priority Data

Dec. 27, 2022 (JP) ..... 2022-209819

(51) Int. Cl.
*F04D 29/28* (2006.01)
*F04D 17/10* (2006.01)
*F04D 29/30* (2006.01)

(52) U.S. Cl.
CPC ..... *F04D 29/284* (2013.01); *F04D 17/10* (2013.01); *F04D 29/30* (2013.01)

(58) Field of Classification Search
CPC ..... F04D 29/284; F04D 29/30; F04D 17/122; F04D 29/681; F04D 17/10;
(Continued)

(56) References Cited

U.S. PATENT DOCUMENTS 4,093,401 A * 6/1978 Gravelle ..... F04D 29/284 416/185
4,502,837 A * 3/1985 Blair ..... F04D 29/284 415/198.1
(Continued)

FOREIGN PATENT DOCUMENTS

JP 5449604 A 4/1979
JP 5971999 U 5/1984
(Continued)

OTHER PUBLICATIONS

International Search Report issued for corresponding International Patent Application No. PCT/JP2023/044252, mailed Feb. 6, 2024 (6 pages).
(Continued)

*Primary Examiner* — Eric J Zamora Alvarez
(74) *Attorney, Agent, or Firm* — Osha Bergman Watanabe & Burton LLP

(57) ABSTRACT

An impeller includes: a disc having a disc shape centered on an axis; a cover disposed away from the disc in an axial direction in which the axis extends; and a plurality of blades connecting the disc and the cover and disposed at intervals in a rotational direction around the axis. Each of the plurality of blades includes: a main vane extending rearward in the rotational direction as the main vane extends from an inner side toward an outer side in a radial direction centered on the axis, and a sub-vane disposed in front of the main vane in the rotational direction at a distance from the main vane, the sub-vane including a leading edge positioned outside a leading edge of the main vane in the radial direction. The
(Continued)

main vane has a lean angle of 0 degrees or more and 20 degrees or less.

6 Claims, 3 Drawing Sheets

(58) Field of Classification Search
CPC ..... F04D 29/4206; F04D 29/286; F04D 29/4213; F04D 29/66; F04D 1/00; F04D 1/04; F04D 29/18; F04D 29/22; F04D 29/24; F04D 29/242; F04D 29/44; F04D 29/544; F01D 5/048; F01D 5/14; F01D 5/141; F01D 5/225
See application file for complete search history.

(56) References Cited

U.S. PATENT DOCUMENTS 5,215,439 A * 6/1993 Jansen ..... F04D 29/284 416/235
6,338,610 B1 * 1/2002 Harada ..... F04D 29/24 416/186 R
6,860,715 B2 * 3/2005 Sekularac ..... F04D 29/681 415/115
9,689,263 B2 * 6/2017 Gharaibah ..... F04D 27/0292
9,897,101 B2 * 2/2018 Saito ..... F04D 29/284
2018/0058468 A1 3/2018 Yanagisawa et al.
2021/0123446 A1 4/2021 Oda et al.
2023/0184258 A1 * 6/2023 Iwakiri ..... F04D 29/30 417/179

FOREIGN PATENT DOCUMENTS

JP 2011122516 A 6/2011
JP 2016033350 A 3/2016
JP 2016191311 A 11/2016
JP 2021067244 A 4/2021

OTHER PUBLICATIONS

Written Opinion issued for corresponding International Patent Application No. PCT/JP2023/044252, mailed Feb. 6, 2024 (8 pages).

* cited by examiner

IMPELLER AND CENTRIFUGAL COMPRESSOR

TECHNICAL FIELD

The present disclosure relates to an impeller and a centrifugal compressor. This application claims priority from Japanese Patent Application No. 2022-209819 filed in Japan on Dec. 27, 2022, the contents of which are incorporated herein by reference.

BACKGROUND ART

As an impeller used in a centrifugal compressor, an impeller of a type called a closed type is known. This type of impeller includes a disc, a blade, and a cover. An outside surface of the disc expands outward in a radial direction as the outside surface extends toward one side in an axial direction. A plurality of the blades arranged at intervals in a circumferential direction are provided at the outside surface. The cover covers these blades from the outside in the radial direction. Thus, in the impeller, an impeller flow path surrounded by a pair of adjacent ones of the blades, the disc, and the cover is formed.

For example, Patent Document 1 discloses a centrifugal compressor including an impeller. The impeller described in Patent Document 1 is a so-called closed impeller including a disc, a plurality of blades provided at the disc, and a cover provided so as to cover the plurality of blades.

CITATION LIST

Patent Literature

Patent Document 1: JP 2011-122516 A

SUMMARY OF INVENTION

Technical Problem

When the peripheral speed of the impeller is increased for improvement of the performance of the centrifugal compressor, a centrifugal stress acting on the heavy cover increases. As a result, a centrifugal stress generated in the impeller becomes larger than that of an open impeller including no cover, which makes it difficult to increase the peripheral speed. Therefore, as to the impeller including the cover, it is required to suppress influence of a centrifugal force acting on the cover and increase the peripheral speed of the impeller including the cover.

The present disclosure provides an impeller and a centrifugal compressor capable of suppressing influence of a centrifugal force acting on a cover and increasing the peripheral speed of the impeller including the cover.

Solution to Problem

An impeller according to the present disclosure includes a disc having a disc shape centered on an axis, a cover disposed away from the disc in an axial direction in which the axis extends, and a plurality of blades connecting the disc and the cover and disposed at intervals in a rotational direction around the axis. Each of the plurality of blades includes a main vane extending rearward in the rotational direction as the main vane extends from an inner side toward an outer side in a radial direction centered on the axis, and a sub-vane disposed in front of the main vane in the rotational direction at a distance from the main vane. The sub-vane includes a leading edge positioned outside a leading edge of the main vane in the radial direction. The main vane has a lean angle of 0 degrees or more and 20 degrees or less. Positions of a tip portion and a hub portion of the leading edge of the main vane in the axial direction coincide with each other as viewed from the rotational direction. The tip portion is connected to the cover. The hub portion is connected to the disc.

A centrifugal compressor according to the present disclosure includes the impeller.

Advantageous Effects of Invention

According to the impeller and the centrifugal compressor of the present disclosure, it is possible to suppress influence of a centrifugal force acting on the cover and increase the peripheral speed of the impeller including the cover.

DESCRIPTION OF EMBODIMENTS

Hereinafter, embodiments for implementing an impeller 40 and a centrifugal compressor 10 according to the present disclosure will be described with reference to the accompanying drawings. However, the present disclosure is not limited only to these embodiments.

Configuration of Centrifugal Compressor

Figure 1:
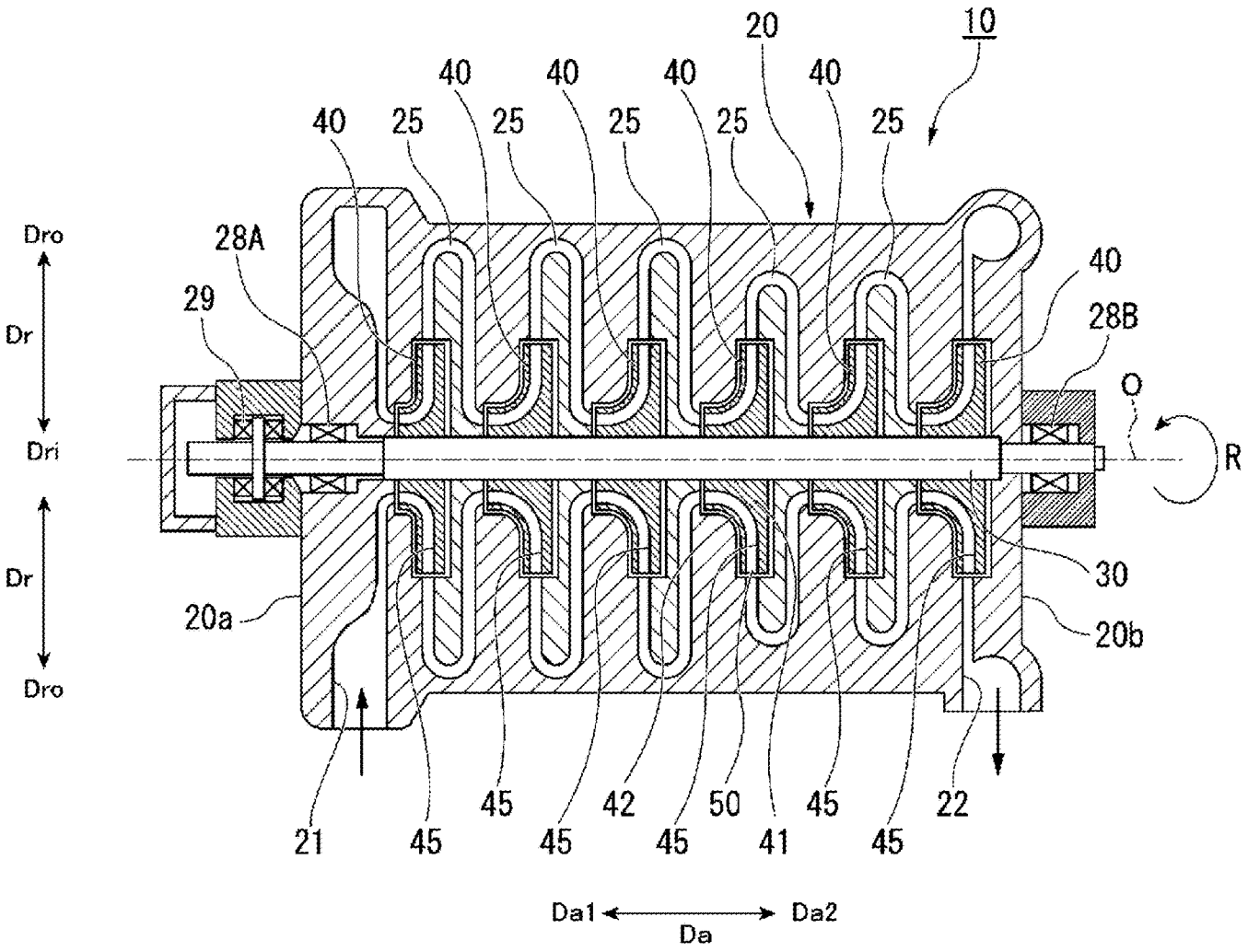
FIG. 1 is a cross-sectional view illustrating a configuration of a centrifugal compressor according to an embodiment of the present disclosure.

Hereinafter, the impeller 40 and the centrifugal compressor 10 according to an embodiment of the present disclosure will be described with reference to FIGS. 1 to 5. As illustrated in FIG. 1, the centrifugal compressor 10 mainly includes a casing 20, a rotor shaft 30, and the impeller 40.

Configuration of Casing

The casing 20 accommodates the impeller 40 and part of the rotor shaft 30. The casing 20 has a tubular shape extending in a direction in which an axis O of the rotor shaft 30 extends (hereinafter, this direction is referred to as an axial direction Da).

In the casing 20, a suction port 21 through which process gas (working fluid) flows into the casing 20 from the outside is formed at a position close to one end portion 20*a* on a first side Dau in the axial direction Da. In addition, in the casing 20, a discharge port 22 through which the process gas flows out to the outside of the casing 20 is formed at a position close to another end portion 20*b* on a second side Dad in the axial direction Da. That is, the one end portion 20*a* side of the first side Dau in the axial direction Da is an upstream side in a flow direction of the process gas in the centrifugal compressor 10. The other end portion 20*b* side of the second side Dad in the axial direction Da is a downstream side in the flow direction of the process gas in the centrifugal compressor 10.

Inside the casing 20, a casing side flow path 25 is formed at a position between a plurality of the impellers 40. The casing side flow path 25 causes the process gas flowing through the impeller 40 to flow from the suction port 21 on the one end portion 20*a* side of the first side Dau in the axial direction Da to the discharge port 22 on the other end portion 20*b* side of the second side Dad in the axial direction Da in the casing 20 through a below-described impeller flow path 45.

Configuration of Rotor Shaft

The rotor shaft 30 is rotatable around the axis O relative to the casing 20. Both ends of the rotor shaft 30 are rotatably supported around the axis O via journal bearings 28A and 28B. At the one end portion 20*a* of the casing 20, a thrust bearing 29 is disposed at a position close to the journal bearing 28A. One end of the rotor shaft 30 is supported in the axial direction Da via the thrust bearing 29.

Configuration of Impeller

Each of the plurality of impellers 40 is attached to the rotor shaft 30 and compresses the process gas using a centrifugal force. The plurality of impellers 40 are housed inside the casing 20 at intervals in the axial direction Da. Note that, in the embodiment of the present disclosure, FIG. 1 illustrates an example in which six impellers 40 are disposed, but it is only required that at least one impeller 40 be disposed.

Figure 2:
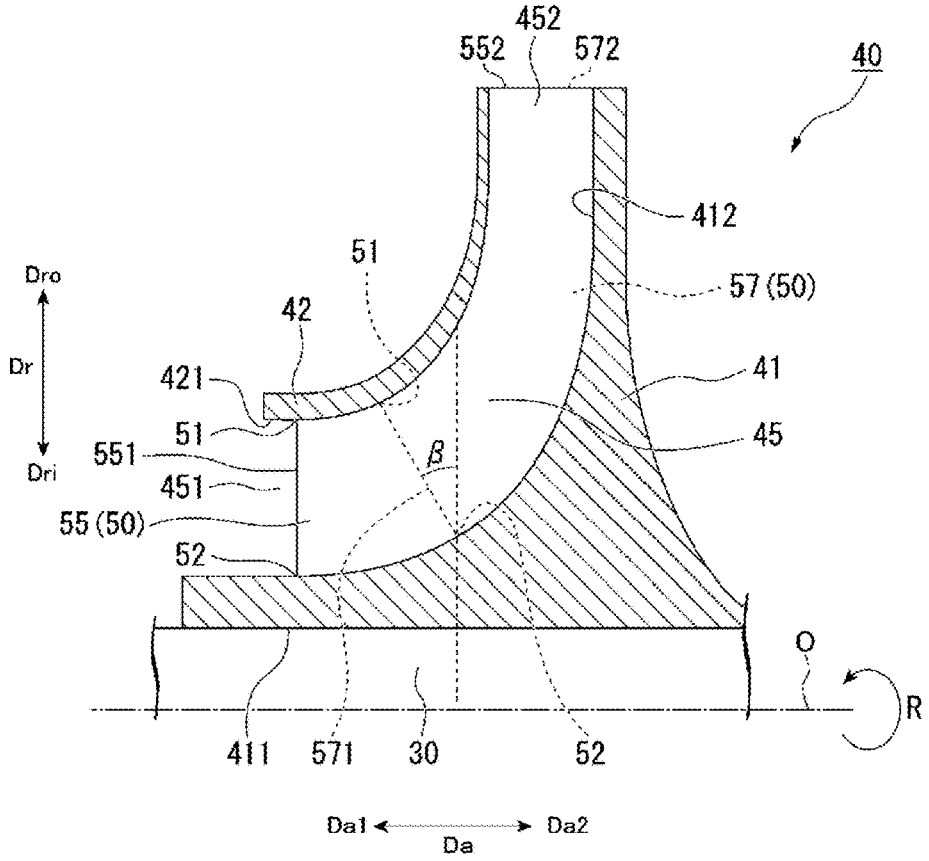
FIG. 2 is a cross-sectional view illustrating a meridian cross section of an upper half of an impeller provided in the centrifugal compressor.
Figure 3:
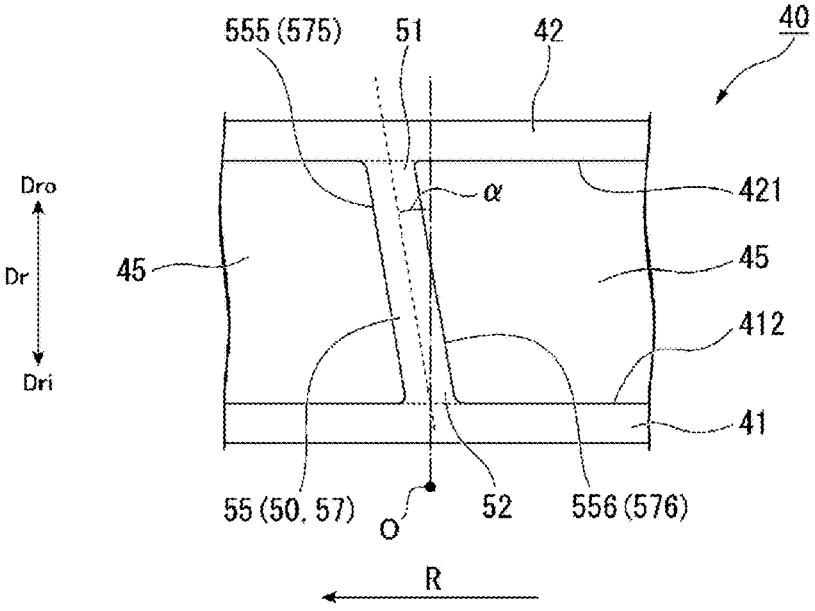
FIG. 3 is a diagram of a blade of the impeller as viewed from a first side in an axial direction.
Figure 4:
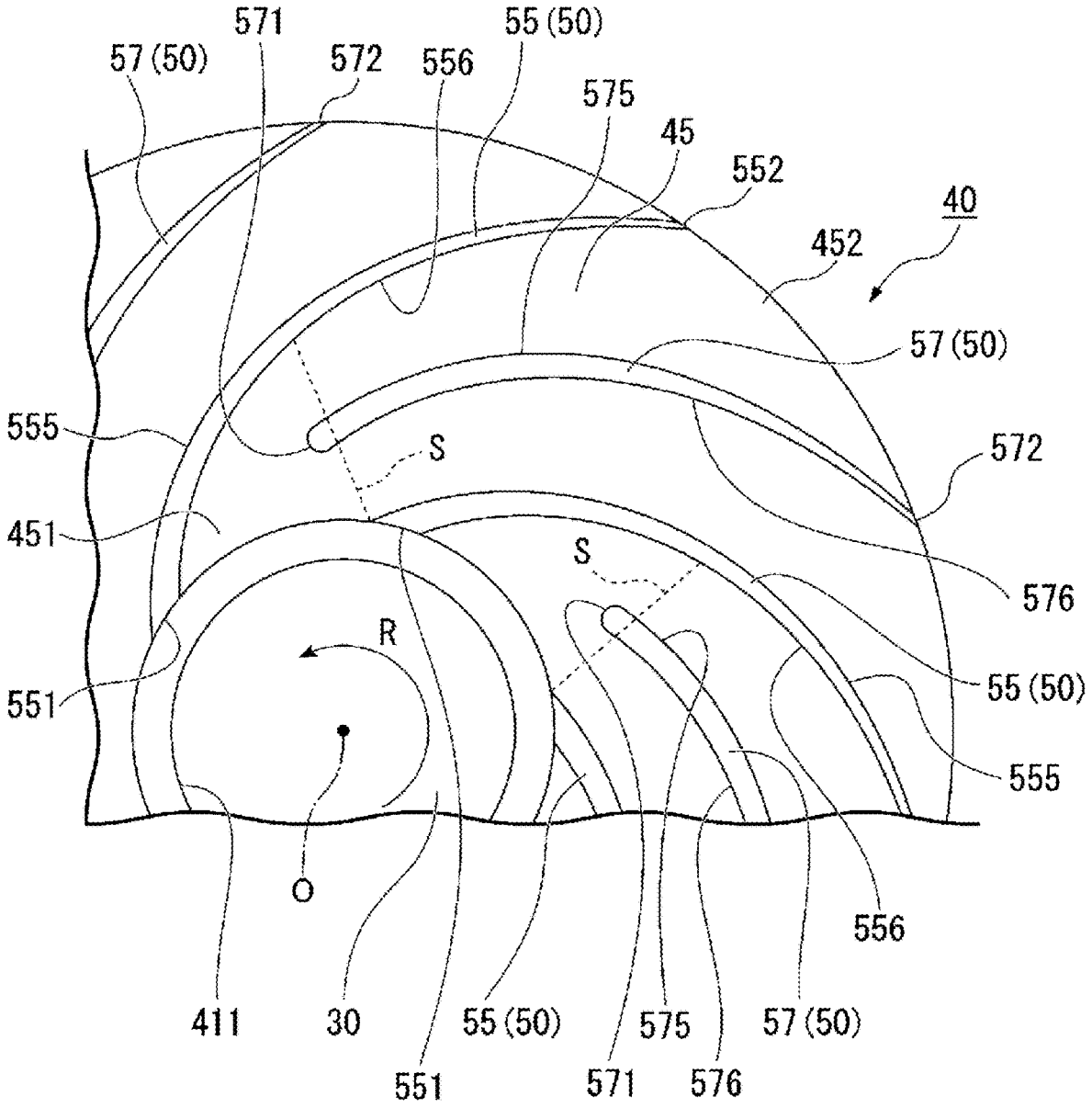
FIG. 4 is a schematic diagram illustrating a shape of the blade when the impeller is viewed from the axial direction.

Each of the impellers 40 is a so-called closed impeller including a disc 41, a blade 50, and a cover 42 as illustrated in FIGS. 2 to 4.

Configuration of Disc

The disc 41 is formed in a disc shape centered on the axis O. As illustrated in FIG. 2, the disc 41 is formed so as to gradually increase in diameter toward an outer side Dro in a radial direction Dr centered on the axis O as the disc 41 extends from the first side Dau toward the second side Dad in the axial direction Da.

At a center portion of the disc 41, a circular through-hole 411 is formed to extend therethrough in the axial direction Da. The impeller 40 is integrally fixed to the rotor shaft 30 in a state where an inner surface of the through-hole 411 is fitted to an outside surface of the rotor shaft 30.

A disc main surface 412 is formed on the first side Dau of the disc 41 in the axial direction Da. The disc main surface 412 expands toward the outer side Dro in the radial direction Dr as the disc main surface 412 extends from the first side Dau toward the second side Dad in the axial direction Da. A part of the disc main surface 412 on the first side Dau in the axial direction Da faces the outer side Dro in the radial direction Dr. A part of the disc main surface 412 on the second side Dad in the axial direction Da faces the first side Dau in the axial direction Da. That is, the disc main surface 412 is curved so as to face the first side Dau in the axial direction Da as the disc main surface 412 extends from the first side Dau toward the second side Dad in the axial direction Da. That is, the disc main surface 412 has a concave curved surface shape. The disc main surface 412 is one of surfaces forming the impeller flow path 45 described below. That is, the disc main surface 412 is a surface of the disc 41 along which the process gas flows.

Configuration of Blade

The blade 50 connects the disc 41 and the cover 42. The blade 50 extends from the disc main surface 412 toward the first side Dau in the axial direction Da. The blade 50 is connected to the cover 42 at a tip portion 51. The blade 50 is connected to the disc 41 at a hub portion 52. A plurality of the blades 50 are disposed at intervals in a rotational direction R around the axis O. The plurality of blades 50 are radially arranged around the axis O toward the outer side Dro in the radial direction Dr. In the present embodiment, each blade 50 includes a main vane 55 and a sub-vane 57 corresponding to the main vane 55. That is, a plurality of pairs of the main vanes 55 and the sub-vanes 57 (for example, six pairs, i.e., twelve vanes in total) are disposed.

The main vane 55 extends from a front side toward a rear side in the rotational direction R as the main vane 55 extends from an inner side Dri toward the outer side Dro in the radial direction Dr. A leading edge 551 of the main vane 55 is disposed at a position close to an end portion of the cover 42 on the first side Dau in the axial direction Da. At the leading edge 551 of the main vane 55, the positions of the tip portion 51 and the hub portion 52 in the axial direction Da coincide with each other as viewed from the rotational direction R. A trailing edge 552 of the main vane 55 is disposed at the same position as an outer peripheral edge of the disc 41 in the radial direction Dr. That is, the trailing edge 552 of the main vane 55 extends to the outer peripheral edge of the disc 41 with no gap therebetween. As illustrated in FIG. 4, the main vane 55 is curved such that an intermediate portion thereof is convex toward the front side in the rotational direction R (one side in the circumferential direction). In the main vane 55, a surface facing the front side in the rotational direction R is a pressure side 555, which is a convex curved surface. In the main vane 55, a surface facing the rear side in the rotational direction R (another side in the circumferential direction) is a suction side 556, which is a concave curved surface. As illustrated in FIG. 3, the main vane 55 has a lean angle $\alpha$ of 0 degrees or more and 20 degrees or less. Here, the lean angle $\alpha$ is an angle of inclination toward the front in the rotational direction R with respect to the disc main surface 412. Preferably, the lean angle $\alpha$ of the main vane 55 is 0 degrees or more and 15 degrees or less. More preferably, the lean angle $\alpha$ of the main vane 55 is 0 degrees or more and 10 degrees or less.

As illustrated in FIG. 4, the sub-vane 57 is disposed in front of the corresponding main vane 55 in the rotational direction R at a distance from the corresponding main vane 55. In other words, one sub-vane 57 is disposed in front of the corresponding main vane 55 in the rotational direction R, and is disposed behind another main vane 55 in the rotational direction R at a distance from the other main vane 55, the other main vane 55 being disposed in front of the corresponding main vane 55 in the rotational direction R. The sub-vane 57 is formed shorter than the main vane 55. The sub-vane 57 extends from the front side toward the rear side in the rotational direction R as the sub-vane 57 extends from the inner side Dri toward the outer side Dro in the radial direction Dr. As illustrated in FIG. 2, a leading edge 571 of the sub-vane 57 is positioned on the outer side Dro in the radial direction with respect to the leading edge 551 of the corresponding main vane 55. The tip portion 51 of the leading edge 571 of the sub-vane 57 is connected to a curved region of the disc main surface 412 as viewed from the rotational direction R. As viewed from the rotational direction R, the leading edge 571 of the sub-vane 57 is inclined at an inclination (inclination angle $\beta$) of 45 degrees or less with respect to a virtual line orthogonal to the axis O on a meridian cross section. Here, the meridian cross section is a cross section of a flow path shape in which a cross section of only the blade 50 is not projected as it is, and a shape obtained by rotationally projecting the shape of the blade 50 along the axis O is superimposed on a longitudinal cross section passing through the axis O. In addition, a trailing edge 572 of the sub-vane 57 is disposed at the same position as the outer peripheral edge of the disc 41 in the radial direction Dr. That is, like the trailing edge 552 of the main vane 55, the trailing edge 572 of the sub-vane 57 extends to the outer peripheral edge of the disc 41 with no gap therebetween.

As illustrated in FIG. 4, at least a part of the leading edge 571 of the sub-vane 57 is positioned upstream of a throat position S between a pair of the main vanes 55 adjacent in the rotational direction R. Here, the throat position S is a position at which a flow path cross-sectional area becomes smallest in the impeller flow path 45 formed between the suction side 556 of the main vane 55 disposed in front of the sub-vane 57 in the rotational direction R and the pressure side 555 of the main vane 55 disposed behind the sub-vane 57 in the rotational direction R in the pair of main vanes 55 adjacent in the rotational direction R. The throat position S of the present embodiment is a position at which a virtual straight line connecting the suction side 556 of the main vane 55 disposed in front of the sub-vane 57 in the rotational direction R and the leading edge 551 of the pressure side 555 of the main vane 55 disposed behind the sub-vane 57 in the rotational direction R becomes shortest in a cross section perpendicular to a blade height direction. An entire region of the leading edge 571 of the sub-vane 57 from the tip portion 51 to the hub portion 52 is positioned upstream of the throat position S. Here, the upstream side is an upstream side in the flow direction of the process gas flowing through the impeller flow path 45, and is a side (position) close to an inflow port 451 of the impeller flow path 45 described below. That is, the entire region of the leading edge 571 of the sub-vane 57 from the tip portion 51 to the hub portion 52 is disposed at a position close to the inflow port 451 of the impeller flow path 45 with respect to the throat position S.

The sub-vane 57 is curved such that an intermediate portion thereof is convex toward the front side in the rotational direction R. That is, the sub-vane 57 is curved in the same direction as the main vane 55. In the sub-vane 57, a surface facing the front side in the rotational direction R is a pressure side 575, which is a convex curved surface. In the sub-vane 57, a surface facing the rear side in the rotational direction R is a suction side 576, which is a concave curved surface. As illustrated in FIG. 3, the lean angle $\alpha$ of the sub-vane 57 is 0 degrees or more and 20 degrees or less in a manner similar to the main vane 55. Preferably, the lean angle $\alpha$ of the sub-vane 57 is 0 degrees or more and 15 degrees or less. More preferably, the lean angle $\alpha$ of the main vane 55 is 0 degrees or more and 10 degrees or less. That is, the lean angle $\alpha$ of the sub-vane 57 is preferably the same as that of the main vane 55.

Configuration of Cover

As illustrated in FIG. 2, the cover 42 is disposed away from the disc 41 on the first side Dau in the axial direction Da with respect to the disc 41. The cover 42 covers the plurality of blades 50 from the first side Dau in the axial direction Da. An end portion of each blade 50 on a side opposite to an end portion connected to the disc main surface 412 is fixed to the cover 42. The cover 42 is disposed to face the disc 41 so as to sandwich the main vanes 55 and the sub-vanes 57 between the cover 42 and the disc 41. The cover 42 is formed to gradually increase in diameter toward the outer side Dro in the radial direction Dr as the cover 42 extends from the first side Dau toward the second side Dad in the axial direction Da. The cover 42 is formed to be thinner toward the outer side Dro in the radial direction Dr. A cover opposing surface 421 opposed to the disc main surface 412 is formed on the second side Dad of the cover 42 in the axial direction Da.

The cover opposing surface 421 expands toward the outer side Dro in the radial direction Dr as the cover opposing surface 421 extends from the first side Dau toward the second side Dad in the axial direction Da. A part of the cover opposing surface 421 on the first side Dau in the axial direction Da faces the outer side Dro in the radial direction Dr. A part of the cover opposing surface 421 on the second side Dad in the axial direction Da faces the second side Dad in the axial direction Da. That is, the cover opposing surface 421 is curved so as to face the second side Dad in the axial direction Da as the cover opposing surface 421 extends from the first side Dau toward the second side Dad in the axial direction Da. That is, the cover opposing surface 421 has a convex curved surface shape. Each of the tip portions 51 of the main vane 55 and the sub-vane 57 is joined to the cover opposing surface 421.

The impeller flow path 45 partitioned by the plurality of blades 50 in the rotational direction R is formed between the disc 41 and the cover 42. The impeller flow path 45 extends while being curved from the inner side Dri toward the outer side Dro in the radial direction Dr as the impeller flow path 45 extends from the first side Dau toward the second side Dad in the axial direction Da. The impeller flow path 45 includes the inflow port 451 that is open on the inner side in the radial direction Dr and on the first side Dau in the axial direction Da, and the outflow port 452 that is open on the outer side Dro in the radial direction Dr and on the first side Dau in the axial direction Da. The inflow port 451 is open toward the first side Dau in the axial direction Da so that the process gas that has flowed through the casing side flow path 25 can flow in. The outflow port 452 is open toward the outer side Dro in the radial direction Dr so that the process gas flows out to the casing side flow path 25.

Actions and Effects

According to the impeller 40 and the centrifugal compressor 10 having the above-described configurations, there are provided the main vanes 55 each of which has the lean angle $\alpha$ of 0 degrees or more and 20 degrees or less and the sub-vanes 57 each of which includes the leading edge 571 positioned on the outer side Dro in the radial direction Dr with respect to the leading edge 551 of the corresponding main vane 55. Further, the leading edge 551 of the main vane 55 is disposed such that the positions of the tip portion 51 and the hub portion 52 in the axial direction Da coincide with each other as viewed from the rotational direction R. Since the lean angle $\alpha$ of the main vane 55 is small and the positions of the tip portion 51 and the hub portion 52 of the leading edge 551 in the axial direction Da coincide with each other, the main vane 55 is connected to the disc main surface 412 and the cover opposing surface 421 in a state of being nearly perpendicular thereto. Accordingly, the cover 42 is firmly supported with respect to the disc 41 by the plurality of main vanes 55. Furthermore, the cover 42 is firmly supported with respect to the disc 41 by the sub-vanes 57 at positions of the impeller 40 on the outer side Dro in the radial direction Dr. Therefore, influence of a centrifugal force acting on the cover 42 can be suppressed while the rigidity of the cover 42 can be increased by the plurality of main vanes 55 and the plurality of sub-vanes 57. This allows the impeller 40 to rotate at high speed.

In addition, not only the lean angle $\alpha$ of the main vane 55 but also the lean angle $\alpha$ of the sub-vane 57 is 0 degrees or more and 20 degrees or less. Therefore, not only the main vane 55 but also the sub-vane 57 is connected to the disc main surface 412 and the cover opposing surface 421 in a state of being nearly perpendicular thereto. Accordingly, the cover 42 is firmly supported with respect to the disc 41 not only by the plurality of main vanes 55 but also by the plurality of sub-vanes 57. Therefore, the rigidity of the cover 42 can be increased by the plurality of sub-vanes 57.

At least a part of the leading edge 571 of the sub-vane 57 is positioned upstream of the throat position S between the pair of main vanes 55. Therefore, between the leading edges 551 of the pair of main vanes 55, the sub-vane 57 acts like a support for the disc main surface 412 and the cover opposing surface 421. That is, the cover 42 is firmly supported with respect to the disc 41 in the vicinity of the leading edge 571 of the sub-vane 57. Therefore, the rigidity of the cover 42 can be increased by the plurality of sub-vanes 57. In particular, in the present embodiment, the entire region of the leading edge 571 of the sub-vane 57 is positioned upstream of the throat position S between the pair of main vanes 55. Therefore, the rigidity of the cover 42 can be further increased by the plurality of sub-vanes 57.

Further, the leading edge 571 of the sub-vane 57 is inclined at an inclination of 45 degrees or less with respect to a virtual line orthogonal to the axis O on the meridian cross section. Therefore, the cover 42 can be supported with respect to the disc 41 by the leading edge 571 of the sub-vane 57 while a loss is suppressed when the process gas flowing through the impeller flow path 45 collides with the leading edge 571 of the sub-vane 57. Further, since the inclination angle β of the leading edge 571 of the sub-vane 57 is 45 degrees or less, processability of the impeller flow path 45 (inside of the impeller 40) can be achieved.

The trailing edge 552 of the main vane 55 and the trailing edge 572 of the sub-vane 57 are disposed at the same position. Specifically, the trailing edge 552 of the main vane 55 and the trailing edge 572 of the sub-vane 57 extend to the outer peripheral edge of the disc 41 in the radial direction Dr. Therefore, a regulating effect by the main vane 55 and the sub-vane 57 can be maintained up to the outflow port 452 of the impeller flow path 45. Therefore, by guiding the process gas up to the outer peripheral edge of the disc 41 by the main vane 55 and the sub-vane 57, it is possible to suppress occurrence of a loss equal to or larger than a loss caused by the position or shape of the leading edge 571 of the sub-vane 57.

OTHER EMBODIMENTS

Although the embodiments of the present disclosure have been described in detail with reference to the accompanying drawings, specific configurations are not limited to this embodiment, and design changes and the like without departing from the gist of the present disclosure are also included.

Note that the lean angle α of the sub-vane 57 is not limited to 0 degrees or more and 20 degrees or less. That is, only the lean angle α of the main vane 55 may be 0 degrees or more and 20 degrees or less, and the lean angle α of the sub-vane 57 may be 20 degrees or more.

In addition, the leading edge 571 of the sub-vane 57 is not limited to having a structure in which the entire region is positioned upstream of the throat position S between the pair of main vanes 55 as in the present embodiment. Therefore, the rigidity of the cover 42 can be further increased by the plurality of sub-vanes 57. It is only required that at least a part of the leading edge 571 of the sub-vane 57 be positioned upstream of the throat position S between the pair of main vanes 55.

The blade 50 is not limited to having a structure including only the main vane 55 and the sub-vane 57 as in the present embodiment. For example, the blade 50 may include a second sub-vane.

Supplementary Notes

The impeller 40 and the centrifugal compressor 10 according to the embodiment described above can be understood as follows, for example.

(1) An impeller 40 according to a first aspect includes the disc 41 having a disc shape centered on the axis O, the cover 42 disposed away from the disc 41 in the axial direction Da in which the axis O extends, and the plurality of blades 50 connecting the disc 41 and the cover 42 and disposed at intervals in the rotational direction R around the axis O, in which each of the plurality of blades 50 includes the main vane 55 extending rearward in the rotational direction R as the main vane 55 extends from the inner side Dri toward the outer side Dro in the radial direction Dr centered on the axis O, and the sub-vane 57 disposed in front of the main vane 55 in the rotational direction R at a distance from the main vane 55, the sub-vane 57 including the leading edge 571 positioned on the outer side Dro in the radial direction Dr with respect to the leading edge 551 of the main vane 55, the main vane 55 has the lean angle α of 0 degrees or more and 20 degrees or less, and positions of the tip portion 51 and the hub portion 52 of the leading edge 551 of the main vane 55 in the axial direction Da coincide with each other as viewed from the rotational direction R, the tip portion 51 being connected to the cover 42, the hub portion 52 being connected to the disc 41.

As a result, since the lean angle α of the main vane 55 is small and the positions of the tip portion 51 and the hub portion 52 of the leading edge 551 in the axial direction Da coincide with each other, the main vane 55 is connected to the disc 41 and the cover 42 in a state of being nearly perpendicular thereto. Accordingly, the cover 42 is firmly supported with respect to the disc 41 by the plurality of main vanes 55. Furthermore, the cover 42 is firmly supported with respect to the disc 41 by the sub-vanes 57 at positions of the impeller 40 on the outer side Dro in the radial direction Dr. Therefore, influence of a centrifugal force acting on the cover 42 can be suppressed while the rigidity of the cover 42 can be increased by the plurality of main vanes 55 and the plurality of sub vanes 57. This allows the impeller 40 to rotate at high speed.

(2) An impeller 40 according to a second aspect is the impeller 40 according to (1), in which the sub-vane 57 has the lean angle α of 0 degrees or more and 20 degrees or less.

Accordingly, not only the main vane 55 but also the sub-vane 57 is connected to the disc 41 and the cover 42 in a state of being nearly perpendicular thereto. Accordingly, the cover 42 is firmly supported with respect to the disc 41 not only by the plurality of main vanes 55 but also by the plurality of sub-vanes 57. Therefore, the rigidity of the cover 42 can be increased by the plurality of sub-vanes 57.

(3) An impeller 40 according to a third aspect is the impeller 40 according to (1) or (2), in which at least a part of the leading edge 571 of the sub-vane 57 is positioned upstream of the throat position S between a pair of the main vanes 55 adjacent in the rotational direction R.

As a result, between the leading edges 551 of the pair of main vanes 55, the sub-vane 57 acts like a support for the disc 41 and the cover 42. That is, the cover 42 is firmly supported with respect to the disc 41 in the vicinity of the leading edge 571 of the sub-vane 57. Therefore, the rigidity of the cover 42 can be increased by the plurality of sub-vanes 57.

(4) An impeller 40 according to a fourth aspect is the impeller 40 according to any one of (1) to (3), in which the leading edge 571 of the sub vane 57 is inclined at an inclination of 45 degrees or less with respect to a virtual line orthogonal to the axis O on a meridian cross section.

Accordingly, the cover 42 can be supported with respect to the disc 41 by the leading edge 571 of the sub-vane 57 while a loss is suppressed when the working fluid flowing through the flow path of the impeller 40 collides with the leading edge 571 of the sub-vane 57. Further, since the inclination angle β of the leading edge 571 of the sub-vane 57 is 45 degrees or less, processability of the inside of the impeller 40 can be achieved.

(5) An impeller 40 according to a fifth aspect is the impeller 40 according to any one of (1) to (4), in which the trailing edge 552 of the main vane 55 and the trailing edge 572 of the sub-vane 57 are disposed at the same position in the radial direction Dr.

Thus, a regulating effect by the main vane 55 and the sub-vane 57 can be maintained up to the outflow port 452 of the impeller flow path 45. Therefore, by guiding the process gas up to the outer peripheral edge of the disc 41 by the main vane 55 and the sub-vane 57, it is possible to suppress occurrence of a loss equal to or larger than a loss caused by the position or shape of the leading edge 571 of the sub-vane 57.

(6) A centrifugal compressor 10 according to a sixth aspect includes the impeller 40 described in any one of (1) to (5).

INDUSTRIAL APPLICABILITY

According to the impeller and the centrifugal compressor of the present disclosure, it is possible to suppress influence of a centrifugal force acting on the cover and increase the peripheral speed of the impeller including the cover.

REFERENCE SIGNS LIST

10 Centrifugal compressor
O Axis
20 Casing
20*a* One end portion
20*b* Other end portion
21 Suction port
22 Discharge port
25 Casing side flow path
30 Rotor shaft
40 Impeller
41 Disc
411 Through-hole
412 Disc main surface
50 Blade
51 Tip portion
52 Hub portion
55 Main vane
551 Leading edge (main vane)
552 Trailing edge (main vane)
555 Pressure side (main vane)
556 Suction side (main vane)
57 Sub-vane
571 Leading edge (sub-vane)
572 Trailing edge (sub-vane)
575 Pressure side (sub-vane)
576 Suction side (sub-vane)
S Throat position
α Lean angle
β Inclination angle
42 Cover
421 Cover opposing surface
45 Impeller flow path
451 Inflow port
452 Outflow port
28A, 28B Journal bearing
29 Thrust bearing
Da Axial direction
Dau First side
Dad Second side
Dr Radial direction
Dro Outer side
Dri Inner side
R Rotational direction

The invention claimed is:

1. An impeller comprising:

a disc having a disc shape centered on an axis;

a cover disposed away from the disc in an axial direction in which the axis extends; and a plurality of blades connecting the disc and the cover and disposed at intervals in a rotational direction around the axis, wherein each of the plurality of blades includes a main vane extending rearward in the rotational direction as the main vane extends from an inner side toward an outer side in a radial direction centered on the axis, and a sub-vane disposed in front of the main vane in the rotational direction at a distance from the main vane, the sub-vane including a leading edge positioned outside a leading edge of the main vane in the radial direction, the main vane has a lean angle of 0 degrees or more and 20 degrees or less, and positions of a tip portion and a hub portion of the leading edge of the main vane in the axial direction coincide with each other as viewed from the rotational direction, the tip portion being connected to the cover, the hub portion being connected to the disc.

2. The impeller according to claim 1, wherein the sub-vane has a lean angle of 0 degrees or more and 20 degrees or less.

3. The impeller according to claim 1, wherein at least a part of the leading edge of the sub-vane is positioned upstream of a throat position between a pair of the main vanes adjacent in the rotational direction.

4. The impeller according to claim 1, wherein the leading edge of the sub-vane is inclined at an inclination of 45 degrees or less with respect to a virtual line orthogonal to the axis on a meridian cross section.

5. The impeller according to claim 1, wherein a trailing edge of the main vane and a trailing edge of the sub-vane are disposed at a same position in the radial direction.

6. A centrifugal compressor comprising the impeller according to claim 1.

* * * * *